US007824321B2

(12) United States Patent
Sato

(10) Patent No.: US 7,824,321 B2
(45) Date of Patent: Nov. 2, 2010

(54) CREASING DEVICE FOR CORRUGATED BOARD SHEET AND CORRUGATED-BOX MAKING MACHINE

(75) Inventor: Hiroshi Sato, Tokyo (JP)

(73) Assignee: Mitsubishi Heavy Industries Printing & Packaging Machinery, Ltd., Hiroshima (JP)

( * ) Notice: Subject to any disclaimer, the term of this patent is extended or adjusted under 35 U.S.C. 154(b) by 7 days.

(21) Appl. No.: 12/120,580

(22) Filed: May 14, 2008

(65) Prior Publication Data

US 2008/0300120 A1 Dec. 4, 2008

(30) Foreign Application Priority Data

May 28, 2007 (JP) ..... 2007-140191

(51) Int. Cl.
*B31B 1/00* (2006.01)

(52) U.S. Cl. ..... 493/69; 493/79; 493/241

(58) Field of Classification Search ..... 493/69, 493/79, 240, 241, 242, 243, 160
See application file for complete search history.

(56) References Cited

U.S. PATENT DOCUMENTS 4,011,798 A * 3/1977 Bambara et al. ..... 493/240
5,393,295 A * 2/1995 Knecht ..... 493/403
5,685,817 A * 11/1997 Feldkamper ..... 493/241
5,690,601 A * 11/1997 Cummings et al. ..... 493/340
6,176,819 B1 * 1/2001 Boegli et al. ..... 493/355
6,508,751 B1 * 1/2003 Weishew et al. ..... 493/59

FOREIGN PATENT DOCUMENTS

| | | |
|---|---|---|
| JP | 11010754 | 1/1999 |
| JP | 2001-113613 A | 4/2001 |
| JP | 2001205718 A | 7/2001 |
| JP | 2001-328181 A | 11/2001 |
| JP | 2004-167971 A | 6/2004 |
| JP | 2005-035076 A | 2/2005 |

* cited by examiner

*Primary Examiner*—Sameh H. Tawfik
(74) *Attorney, Agent, or Firm*—Lowe Hauptman Ham & Berner LLP

(57) ABSTRACT

A slotter-creaser unit includes an upper creasing head and a lower creasing head. A protruding portion is arranged on a periphery of the lower creasing head in a circumferential direction. A first pressing portion and a second pressing portion having different lengths and different curvature radiuses in a width direction are arranged opposite to each other across the protruding portion and in an alternate manner in the circumferential direction.

3 Claims, 8 Drawing Sheets

CREASING DEVICE FOR CORRUGATED BOARD SHEET AND CORRUGATED-BOX MAKING MACHINE

RELATED APPLICATIONS

The present application is based on, and claims priority from, Japan Application Number 2007-140191, filed May 28, 2007, the disclosure of which is hereby incorporated by reference herein in its entirety.

BACKGROUND OF THE INVENTION

1. Field of the Invention

The present invention relates to a creasing device for a corrugated board sheet and a corrugated-box making machine for making a corrugated box using the corrugated board sheet.

2. Description of the Related Art

A corrugated-box making machine generally makes a corrugated box from a corrugated board sheet having a fluted inner sheet glued between linerboards. The corrugated-box making machine generally includes a feeding unit, a printing unit, a slotter-creaser unit, a folding unit, and a counter-ejector unit.

The feeding unit includes a kicker and a pair of feed rolls to feed a corrugated board sheet to a printing unit. Specifically, the kicker is reciprocated by a crank lever to kick out a corrugated board sheet piled on a table, and the feed rolls nip the corrugated board sheet to convey it to the printing unit at a predetermined speed.

The printing unit performs a monochrome or a multicolor printing, and includes at least one printing unit. The printing unit includes a printing cylinder with a printing die. An ink supply roll is arranged near the printing cylinder and in contact with the printing die. An ink chamber, in which ink is contained, is arranged near the ink supply roll. Upon printing an image or a text, the ink chamber supplies the ink onto a surface of the ink supply roll, and the applied ink is transferred onto the printing die. A counter roll is arranged below the printing cylinder so that the corrugated board sheet is nipped between the printing die and the counter roller for the printing.

The slotter-creaser unit performs a creasing process by a first creasing roll and a second creasing roll on a printed corrugated board sheet, and then performs a slotting process by a slotter knife on a creased corrugated board sheet.

The folding unit conveys the corrugated board sheet to a glue applying unit to apply glue onto a joint flap. The corrugated board sheet with the glue applied is further conveyed to the folding bar and a folding belt to fold the corrugated board sheet thereby jointing the joint flap. As a result, a corrugated box is formed. The counter-ejector unit piles the corrugated box formed by folding and gluing the corrugated board sheet in a hopper unit. A predetermined number of piled corrugated boxes are grouped into a batch, and the batch is delivered.

The slotter-creaser unit in the above corrugated-box making machine is configured to form a crease necessary for folding the corrugated board sheet by the folding unit. The slotter-creaser unit includes a rotatable creasing roll and a counter roll arranged opposite to the creasing roll. The creasing roll is fixed to a crease shaft, and a protruding portion corresponding to a center portion of the crease is arranged on the periphery of the creasing roll in the circumferential direction. Furthermore, pressing portions are arranged on the both sides of the protruding portion in the circumferential direction. When the corrugated board sheet is nipped between the creasing roll and the counter roll while being conveyed, the protruding portion of the creasing roll forms a crease along with a flute of the fluted inner sheet and the pressing portion forms a pressed portion on the both sides of the crease. Therefore, the corrugated board sheet can be folded along the crease with the pressed portion by the folding unit.

The above creasing devices are disclosed in, for example, Japanese Patent Application Laid-open No. 2001-328181 and Japanese Patent Application Laid-open No. 2005-035076.

A configuration of the fluted inner sheet glued between an outer linerboard and an inner linerboard of the corrugated board sheet can be changed depending on its use. Specifically, the strength of the corrugated board sheet can be changed depending on various factors. Examples of the factors include a height and a pitch of a flute of the fluted inner sheet, a thickness and sheet quality of the inner linerboard, the outer linerboard, and the fluted inner sheet, and the number of the fluted inner sheets to be sandwiched between the outer and the inner linerboards.

To manufacture the corrugated box with desired quality by the corrugated-box making machine, it is necessary to fold the corrugated board sheet appropriately at a predetermined position. Therefore, a crease needs to be formed clearly at an accurate position. The slotter-creaser unit in the conventional corrugated-box making machine can set a width of the pressing portion of the creasing roll depending on the strength of the corrugated board sheet. Specifically, when the strength of the corrugated board sheet is high, the width of the pressing portion is set wide to form a wide pressed portion on the both sides of the crease. Therefore, portions (inner parts) on the both sides of the crease do not interfere with each other when the corrugated board sheet is folded. Thus, degree of folding precision can be preserved. On the other hand, when the strength of the corrugated board sheet is low, the width of the pressing portion is set narrow to form a narrow pressed portion on the both sides of the crease. Therefore, a folding position can be uniformly set to assuredly fold the corrugated board sheet at the crease position to prevent degradation of the folding precision.

However, if the creasing roll is replaced depending on the strength of the corrugated board sheet to be processed into the corrugated box, it is necessary to suspend the corrugated-box making machine during a processing operation, resulting in degradation of operation efficiency. Therefore, the conventional corrugated-box making machine generally sets a width of the pressing portion to a normal width applicable for the corrugated board sheets with both high strength and low strength to eliminate necessity of replacement of the creasing roll. As a result, the pressed portion is not wide enough for the corrugated board sheet with high strength while it is too narrow for the corrugated board sheet with low strength. Thus, the folding position cannot be set uniform, resulting in degradation of the folding precision.

SUMMARY OF THE INVENTION

It is an object of the present invention to at least partially solve the problems in the conventional technology.

According to an aspect of the present invention, a creasing device includes a creasing roll having a protruding portion corresponding to a center position of the crease and arranged on a periphery of the creasing roll in a circumferential direction, and a pressing portion arranged on both sides of the protruding portion in a width direction, wherein the pressing portion includes a first pressing portion and a second pressing portion having different lengths in the width direction and arranged opposite to each other across the protruding portion and in an alternate manner in the circumferential direction.

According to another aspect of the present invention, a creasing device includes a creasing roll having a protruding portion corresponding to a center position of the crease and arranged on a periphery of the creasing roll in a circumferential direction, and a pressing portion arranged on both sides of the protruding portion in a width direction, wherein the pressing portion includes a first pressing portion and a second pressing portion having different curvature radiuses in the width direction and arranged opposite to each other across the protruding portion and in an alternate manner in the circumferential direction.

According to still another aspect of the present invention, a corrugated-box making machine includes a feeding unit, a printing unit, a slotter-crease unit, a folding unit, and a counter-ejector unit. The slotter-creaser unit includes a creasing roll having a protruding portion corresponding to a center position of the crease and arranged on a periphery of the creasing roll in a circumferential direction, and a pressing portion arranged on both sides of the protruding portion in a width direction, wherein the pressing portion includes a first pressing portion and a second pressing portion having different lengths or different curvature radiuses in the width direction and arranged opposite to each other across the protruding portion and in an alternate manner in the circumferential direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings. The present invention is not limited to the below embodiments.

Figure 1:
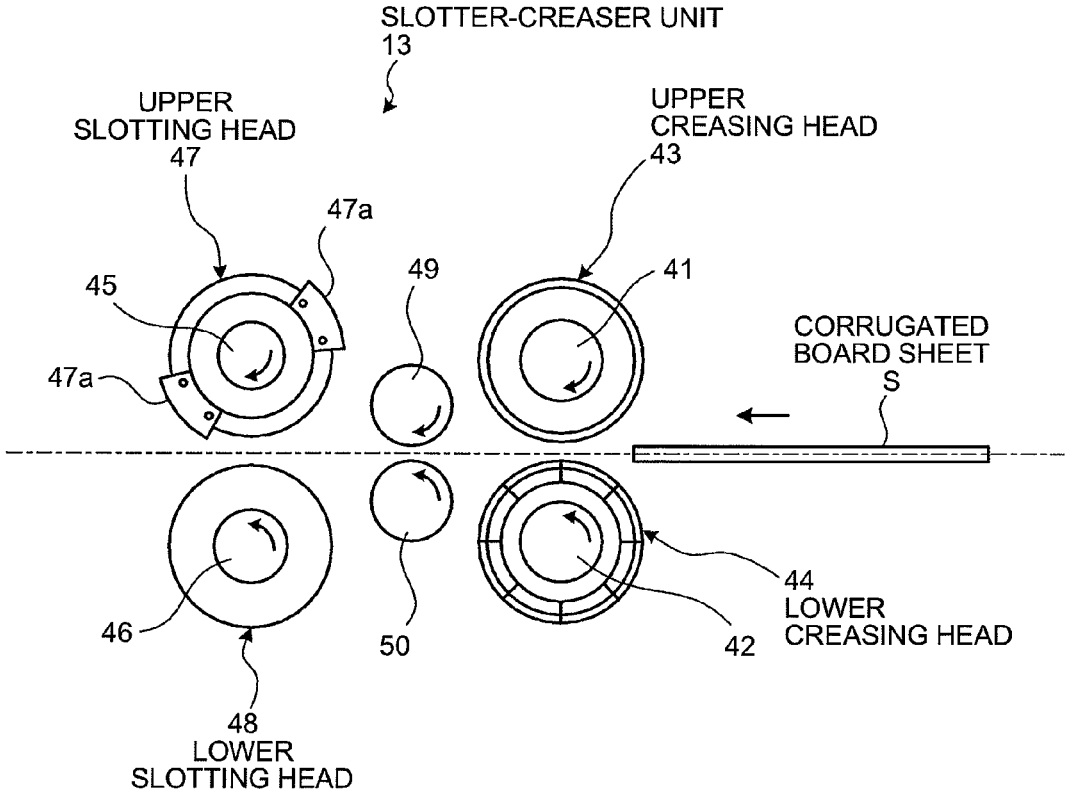
FIG. 1 is a schematic diagram of a creasing device for a corrugated board sheet according to an embodiment of the present invention.
Figure 2:
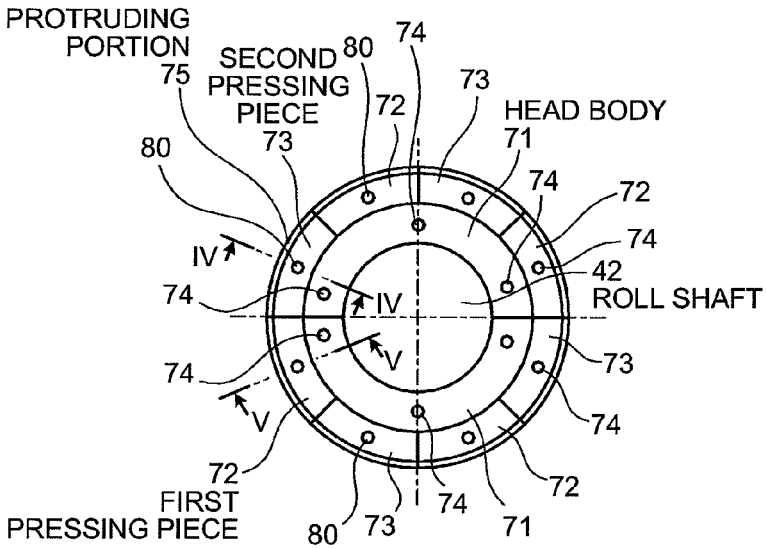
FIG. 2 is a front side view of a creasing roll in the slotter-creaser unit shown in FIG. 1.
Figure 3:
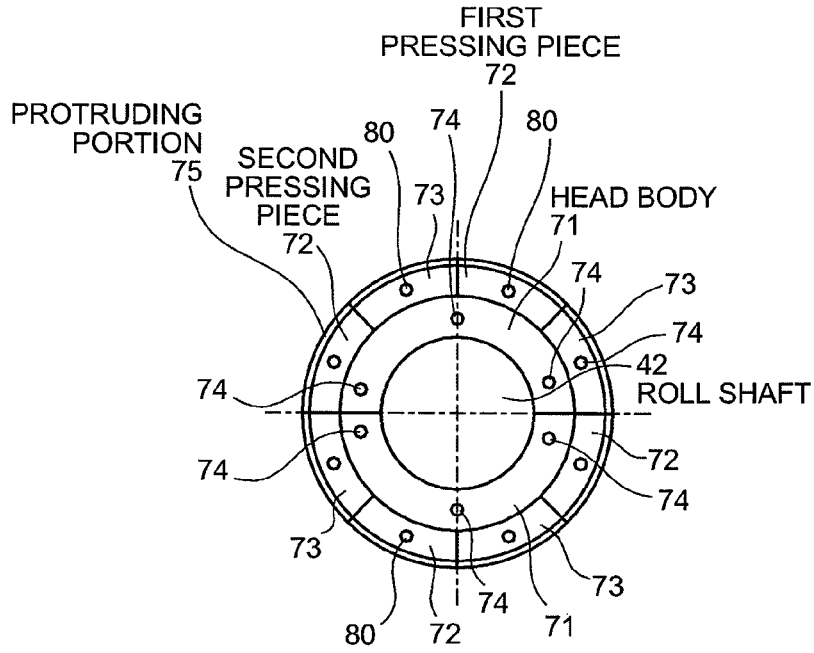
FIG. 3 is a backside view of the creasing roll shown in FIG. 2.
Figure 4:
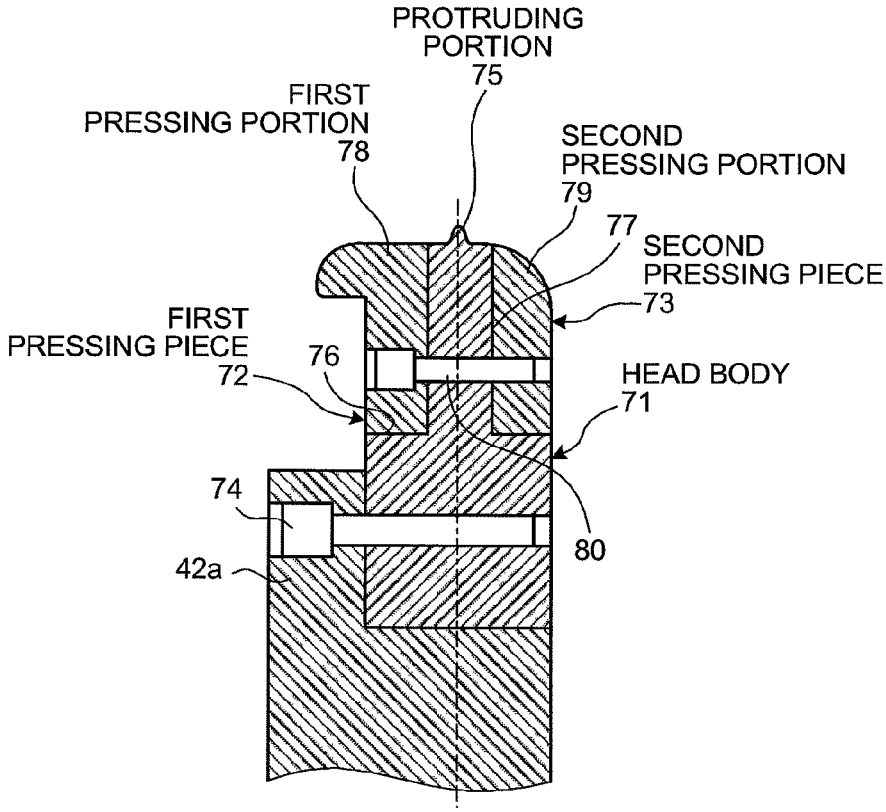
FIG. 4 is a cross section of the creasing roll taken from line IV-IV of FIG. 2.
Figure 5:
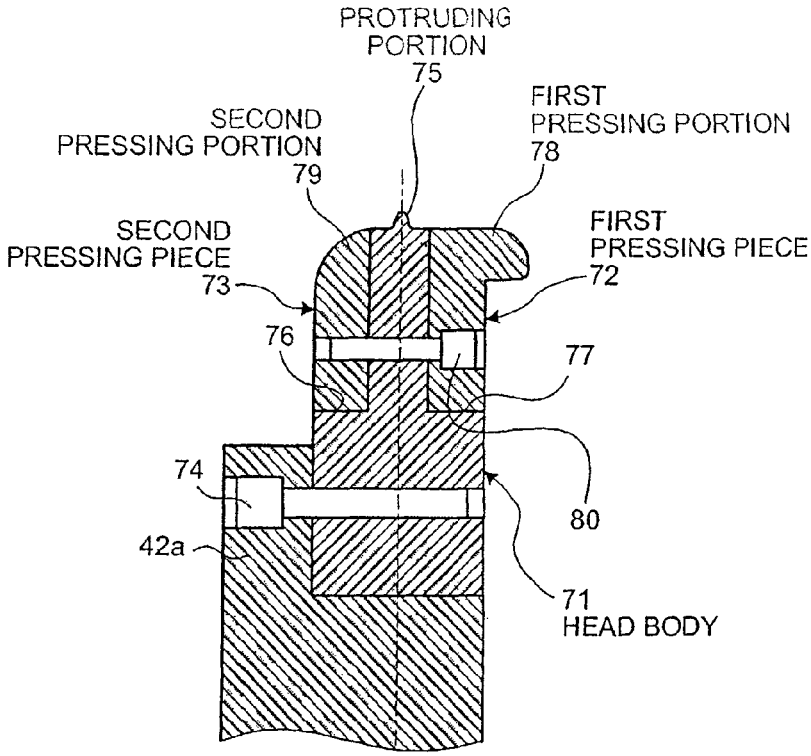
FIG. 5 is a cross section of the creasing roll taken from line V-V of FIG. 2.
Figure 6:
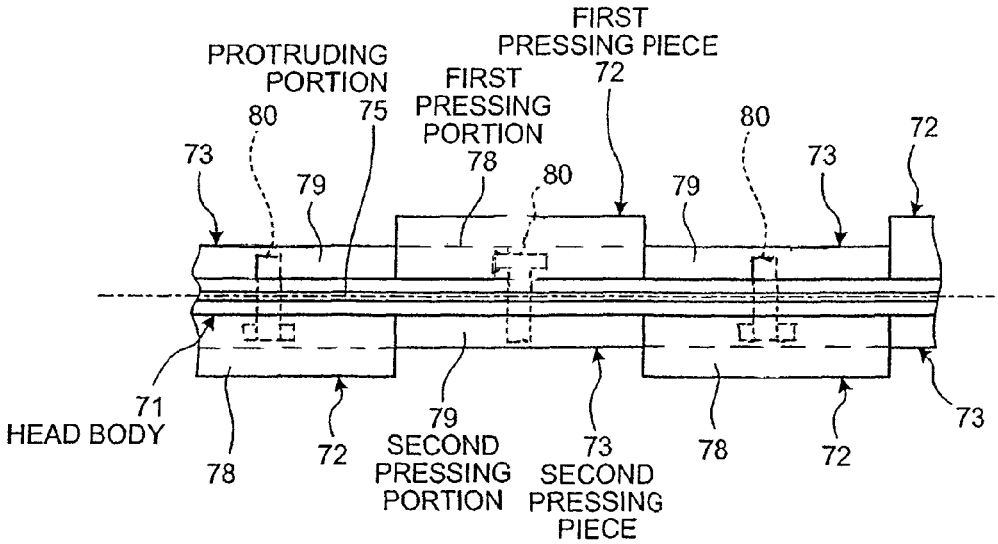
FIG. 6 is a side view of the creasing roll shown in FIG. 2.
Figure 7:
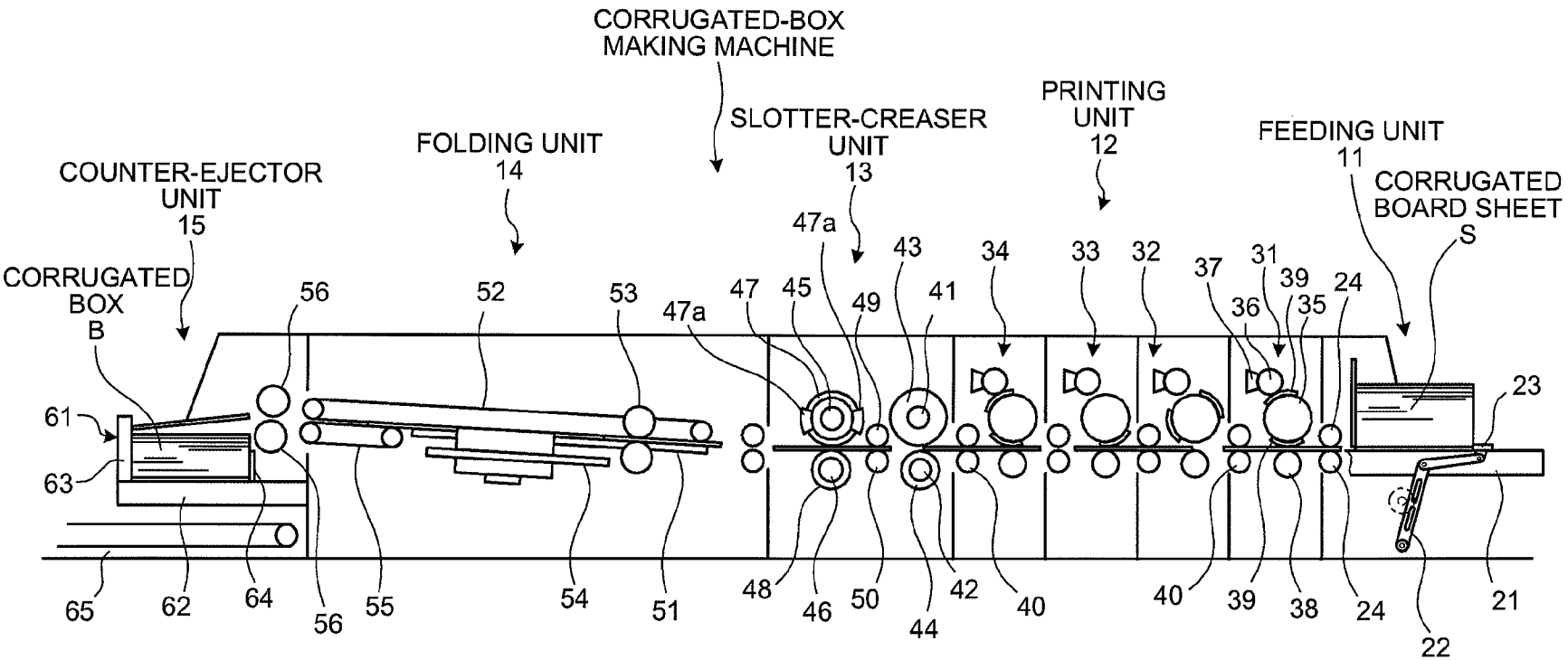
FIG. 7 is a schematic diagram of a corrugated-box making machine according to the embodiment.
Figure 8:
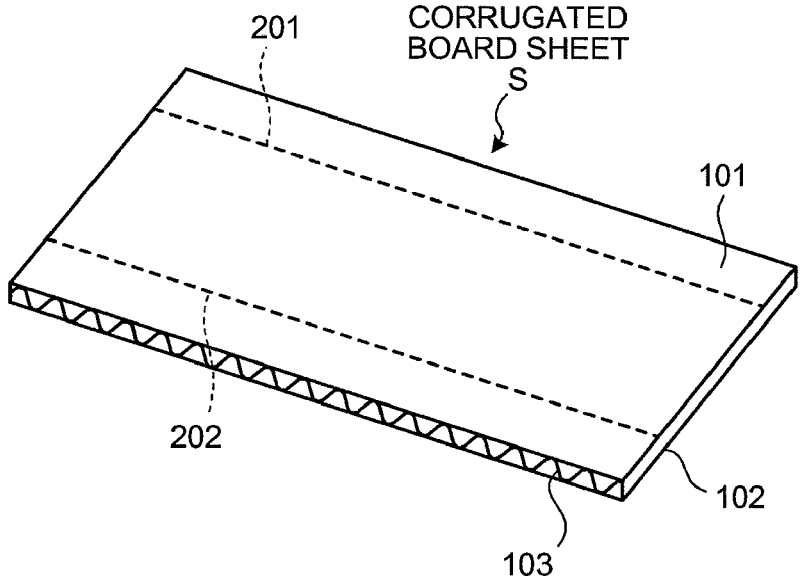
FIG. 8 is a perspective view of an unprocessed corrugated board sheet according to the embodiment.
Figure 9:
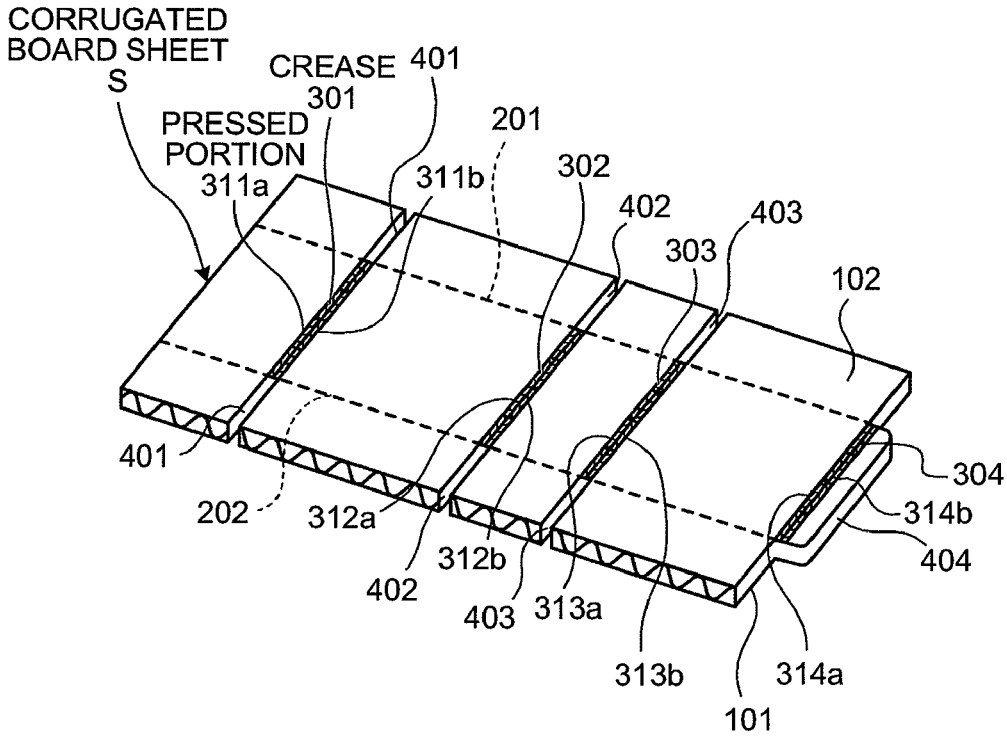
FIG. 9 is a perspective view of a corrugated board sheet subjected to creasing and slotting processing.
Figure 10:
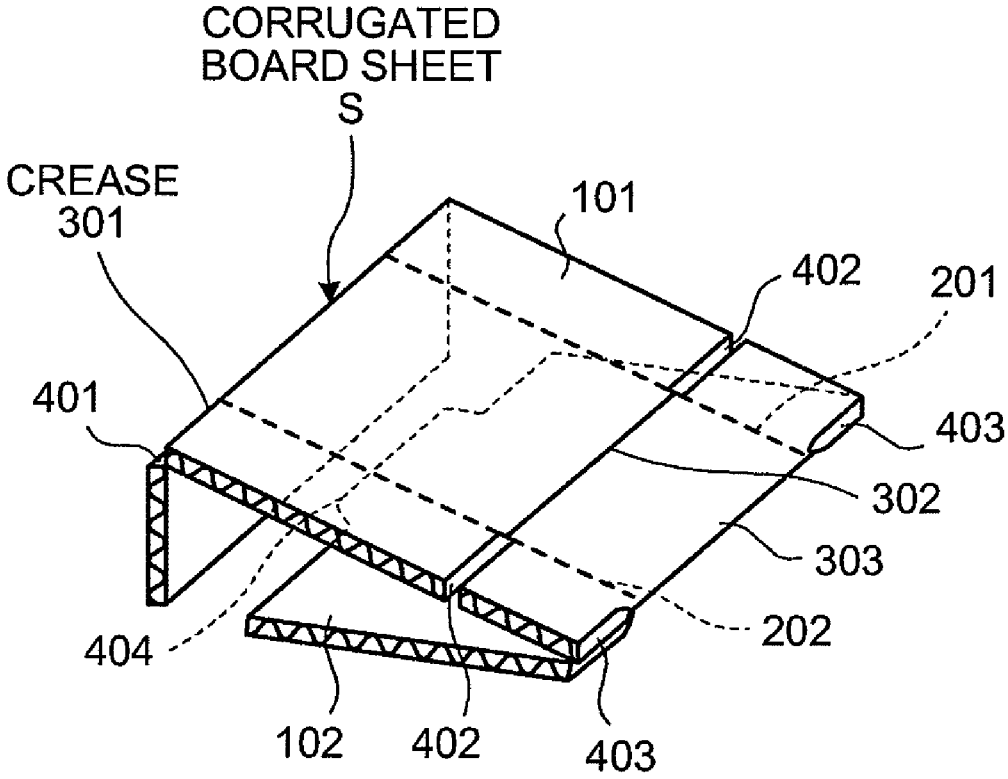
FIG. 10 is a perspective view of a folded corrugated board sheet according to the embodiment.

FIG. 1 is a schematic diagram of a creasing device for a corrugated board sheet according to an embodiment of the present invention; FIG. 2 is a front side view of a creasing roll in the slotter-creaser unit shown in FIG. 1; FIG. 3 is a backside view of the creasing roll shown in FIG. 2; FIG. 4 is a cross section of the creasing roll taken from line IV-IV of FIG. 2; FIG. 5 is a cross section of the creasing roll taken from line V-V of FIG. 2; FIG. 6 is a side view of the creasing roll shown in FIG. 2; FIG. 7 is a schematic diagram of a corrugated-box making machine according to the embodiment; FIG. 8 is a perspective view of an unprocessed corrugated board sheet according to the embodiment; FIG. 9 is a perspective view of a corrugated board sheet obtained by performing creasing and slotting processing; FIG. 10 is a perspective view of a folded corrugated board sheet; and FIGS. 11A to 11E are schematic diagrams for explaining a processing procedure for processing a corrugated board sheet by the corrugated-box making machine shown in FIG. 7.

A corrugated-box making machine including a creasing device for a corrugated board sheet according to an embodiment of the present invention performs processing on a corrugated board sheet S to manufacture a corrugated box B. The corrugated-box making machine includes a feeding unit 11, a printing unit 12, a slotter-creaser unit (the creasing device) 13, a folding unit 14, and a counter-ejector unit 15. The corrugated board sheet S is formed by an outer linerboard and an inner linerboard with a fluted inner sheet glued between the outer and the inner linerboards. The strength of the corrugated board sheet S varies depending on various factors. Examples of the factors include a height and a pitch of a flute of the fluted inner sheet, a thickness and paper quality of the outer linerboard, the inner linerboard, and the corrugated medium, and the number of the corrugated medium to be sandwiched by the outer linerboard and the inner linerboard.

A number of the corrugated board sheets S are stacked on a table 21 in the feeding unit 11. A kicker 23 is reciprocated by a crank lever mechanism 22, and kicks out the corrugated board sheet S at the bottom of the stack one by one toward a pair of upper and lower feed rolls 24. The upper and lower feed rolls 24 rotate at a predetermined speed and nip the corrugated board sheet S kicked out by the kicker 23 to convey it to the printing unit 12.

The printing unit 12 includes four printing units 31 to 34 to perform a color printing using four colors (e.g., cyan, magenta, yellow, and black). Each of the four printing units 31 to 34 has the same configuration that includes a printing cylinder 35, an ink supply roll 36, an ink chamber 37, and a counter roll 38. A printing die 39 is arranged on the periphery of the printing cylinder 35. The ink supply roll 36 is in contact with the printing die 39 and arranged near the printing cylinder 35. The ink chamber 37 contains ink and is arranged near the ink supply roll 36. The counter roll 38 is arranged at a position opposite to and the lower side of the printing cylinder 35.

The ink is supplied from the ink chamber 37 to the surface of the ink supply roll 36 in the printing unit 31, so that when the printing cylinder 35 and the ink supply roll 36 rotate in a synchronous manner, the ink on the ink supply roll 36 is transferred onto the printing die 39. At this state, when the corrugated board sheet S is conveyed between the printing cylinder 35 and the counter roll 38, an image or a text is printed on the surface of the corrugated board sheet S sandwiched between the printing die 39 (the printing cylinder 35) and the counter roll 38. A pair of upper and lower conveying rolls 40 is arranged on the downstream side of the printing cylinder 35 and the counter roll 38. The upper and lower conveying rolls 40 conveys the corrugated board sheet S to a next printing unit 32.

The slotter-creaser unit 13 performs a creasing process and a slotting process on the corrugated board sheet S, and includes an upper roll shaft 41, a lower roll shaft 42, an upper slotter shaft 45, and a lower slotter shaft 46. An upper creasing head 43 is fixed around the upper roll shaft 41 and a lower creasing head (creasing roll) 44 is fixed on the lower roll shaft 42. The upper creasing head 43 and the lower creasing head 44 are configured to rotate in a synchronous manner. Furthermore, an upper slotting head 47 is arranged on the upper slotter shaft 45 and a lower slotting head 48 is arranged on the lower slotter shaft 46. The upper slotting head 47 and the lower slotting head 48 are configured to rotate in a synchronous manner. An upper conveying roll 49 and a lower conveying roll 50 are arranged between the creasing heads 43 and 44, and the slotting heads 47 and 48, and configured to rotate in a synchronous manner.

The upper and the lower creasing heads 43 and 44 form a crease on the surface of the corrugated board sheet S conveyed between the heads 43 and 44. The upper and the lower slotting heads 47 and 48 perform a slotting process on the corrugated board sheet S conveyed between the heads 47 and 48. To perform the slotting process, two slotter knives 47*a* are fixed on the periphery of the upper slotting head 47. The upper and the lower creasing heads 43 and 44, and the upper and the lower slotting heads 47 and 48 are arranged in plural along a direction of the shaft. Specifically, four pairs are arranged according to the embodiment.

The folding unit 14 applies glue on a joint flap while conveying the corrugated board sheet S, and folds the corrugated board sheet S while jointing the joint flap thereby making the corrugated box B. A guide rail 51 is arranged along a conveying direction of the corrugated board sheet S, and a conveying belt 52 is arranged above the guide rail 51 in a circular manner. A glue applying unit 53, a folding bar 54, and a folding belt 55 are arranged along the guide rail 51 and the conveying belt 52.

The corrugated board sheet S with a slot and the joint flap is subjected to a process of applying glue to the joint flap by the glue applying unit 53 and then folded by the folding bar 54 during conveyance of the corrugated board sheet S held by the guide rail 51 and the conveying belt 52 in the folding unit 14. When the corrugated board sheet S is folded by 180 degrees or closer, additive folding force is applied on the corrugated board sheet S due to an action of the conveying belt 52. Then a pair of upper and lower delivery rolls 56 firmly presses the joint flap thereby assuredly jointing the joint flap, and delivers the corrugated board sheet S.

The counter-ejector unit 15 piles the corrugated boxes B formed by gluing and folding the corrugated board sheet S, groups the predetermined number of the corrugated boxes B into a batch, and delivers the corrugated boxes B. The counter-ejector unit 15 includes a hopper device 61. The hopper device 61 includes an elevator 62 configured to move up and down, a ware plate 63, and an aligning plate 64. A transfer conveyor 65 is arranged below the elevator 62.

When the corrugated box B is delivered by the upper and the lower delivery rolls 56, the leading edge of the corrugated box B hits the ware plate 63. Therefore, horizontal conveyance is stopped, so that the corrugated box B falls down in piles on the elevator 62 and aligned by the aligning plate 64. If the predetermined number of the corrugated boxes B are piled on the hopper device 61, the elevator 62 moves down to deliver a batch of boxes (predetermined number of the corrugated boxes B) onto the transfer conveyor 65. The transfer conveyor 65 then transfers the batch of the boxes to next processing.

As described above, the slotter-creaser unit 13 includes the upper creasing head 43 on the upper roll shaft 41, the lower creasing head 44 on the lower roll shaft 42, the upper slotting head 47 on the upper slotter shaft 45, the lower slotting head 48 on the lower slotter shaft 46, and the upper and the lower conveying rolls 49 and 50.

According to the embodiment, a protruding portion corresponding to a center position of the crease is arranged on the periphery of the lower creasing head 44, and pressing portions (a first pressing portion and a second pressing portion) are arranged on the both sides of the protruding portion along a width direction. Therefore, the lower creasing head 44 forms a crease along the flute of the fluted inner sheet of the corrugated board sheet S by the protruding portion, and a pressed portion on the both sides of the crease by the pressing portion. Each of the first and the second pressing portions has a different length and a difference curvature radius in the width direction. The first and the second pressing portions are arranged on the both sides of the protruding portion thereby sandwiching the protruding portion, and alternately arranged in a circumferential direction.

Specifically, as shown in FIGS. 2 to 6, the lower creasing head 44 includes two head bodies (roll bodies) 71, eight first pressing pieces 72, and eight second pressing pieces 73. Each of the head body 71 is a semicircular member evenly split in a circumferential direction, and connected with each other to form a ring shape. The head bodies 71 are fixed by a bolt 74 to a flange portion 42*a* integrated with the lower roll shaft 42. A protruding portion 75 is arranged on the entire periphery of the head bodies 71 in the circumferential direction, and a first attaching portion 76 and a second attaching portion 77 are arranged on the both sides of the protruding portion in the width direction.

The first pressing piece 72 includes the first pressing portion 78 in a shape having a longer length and a smaller curvature radius in the width direction, and is fitted to the first attaching portion 76 or the second attaching portion 77 of the head body 71. The second pressing piece 73 includes the second pressing portion 79 in a shape having a shorter length and larger curvature radius in the width direction, and is fitted to the first attaching portion 76 or the second attaching portion 77 of the head body 71. At the state where the first and the second pressing pieces 72 and 73 are respectively fitted to one of the first attaching portion 76 and the second attaching portion 77, the bolt 80 is fasten through the first pressing piece 72, the head body 71, and the second pressing piece 73 to fix the first and the second pressing pieces to the head body 71.

At this state, the first pressing piece 72 (the first pressing portion 78) and the second pressing piece 73 (the second pressing portion 79) are fixed to the first attaching portion 76 and the second attaching portion 77, respectively, on the both sides of the protruding portion 75 opposite to each other. Specifically, as shown in FIG. 4, when the first pressing piece 72 is fixed to the first attaching portion 76 and the second pressing piece 73 is fixed to the second attaching portion 77, the first pressing portion 78 with the wide width and the small curvature radius is arranged on one side of the protruding portion 75 and the second pressing portion 79 with the narrow width and the large curvature radius is arranged on the opposite side in the width direction. On the other hand, as shown in FIG. 5, when the second pressing piece 73 is fixed to the first attaching portion 76 and the first pressing piece 72 is fixed to the second attaching portion 77, the first pressing portion 78 with the wide width and the small curvature radius is arranged on one side of the protruding portion 75 and the second pressing portion 79 with the narrow width and the large curvature radius is arranged on the opposite side in the width direction, in the manner opposite to that shown in FIG. 4. That is, the first and the second pressing portions 78 and 79 are evenly divided into two parts in the width direction and evenly divided into eight parts in the circumferential direction.

Furthermore, in the lower creasing head 44, the first pressing piece 72 and the second pressing piece 73 are alternately fixed in the circumferential direction, and the first pressing piece 72 (the first pressing portion 78) and the second pressing piece 73 (the second pressing portion 79) are alternately arranged in accordance with the length of the corrugated board sheet. Specifically, the length of the first and the second pressing pieces 72 and 73, that is, the number of divided parts, is determined so that at least one pressed portion is formed by each of the first and the second pressing portions 78 and 79 along the conveyance direction of the corrugated board sheet S when the lower creasing head 44 rotates to form the crease on the surface of the corrugated board sheet S by the protruding portion 75 and form the pressed portion on the both sides of the crease by the first and the second pressing portions 78 and 79.

The upper creasing head 43 is arranged on an upper side of and opposite to the lower creasing head 44, and urethane (not shown) is fixed on the periphery of the upper creasing head 43.

A method of manufacturing the corrugated board sheet S by the corrugated-box making machine according to the embodiment is described below.

Figure 11A:
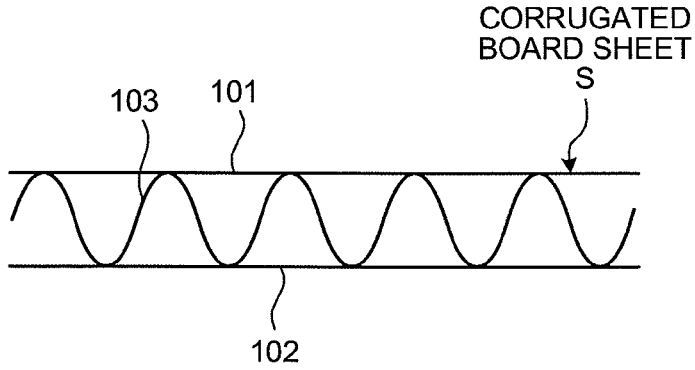
FIGS. 11A to 11E are schematic diagrams for explaining a processing procedure for processing a corrugated board sheet by the corrugated-box making machine shown in FIG. 7.

As shown in FIGS. 8 and 11A, the corrugated board sheet S is formed by an outer linerboard 101 and an inner linerboard 102 that sandwich a fluted inner sheet 103 using glue, and two scores 201 and 202 are formed through previous processing. As shown in FIG. 7, the corrugated board sheet S is piled on the feeding unit 11, and the bottom one of the stack is fed one by one to the feed rolls 24 by the kicker 23 reciprocated by the crank lever mechanism 22 thereby being conveyed to the printing unit 12. The printing unit 12 performs a printing on the surface of the corrugated board sheet S using four colors of the printing units 31 to 34.

After the printing is performed by the printing unit 12, the corrugated board sheet S is conveyed to the slotter-creaser unit 13 by the conveying rolls 40. The slotter-creaser unit 13 performs the creasing process and the slotting process on the corrugated board sheet S. Specifically, as shown in FIGS. 1 to 6, the corrugated board sheet S is processed while passing between the upper creasing head 43 and the lower creasing head 44 in the slotter-creaser unit 13, so that creases 301 to 304 (see FIG. 9) are formed on the surface of the inner linerboard 102 by the protruding portion 75 of the lower creasing head 44, and pressed portions 311*a*, 311*b*, 312*a*, 312*b*, 313*a*, 313*b*, 314*a*, and 314*b* (see FIG. 9) are formed on both sides of each of the creases 301 to 304.

Figure 11B:
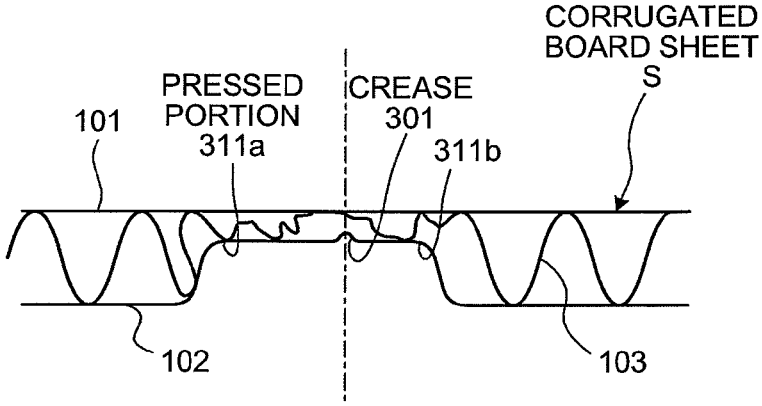
Figure 11C:
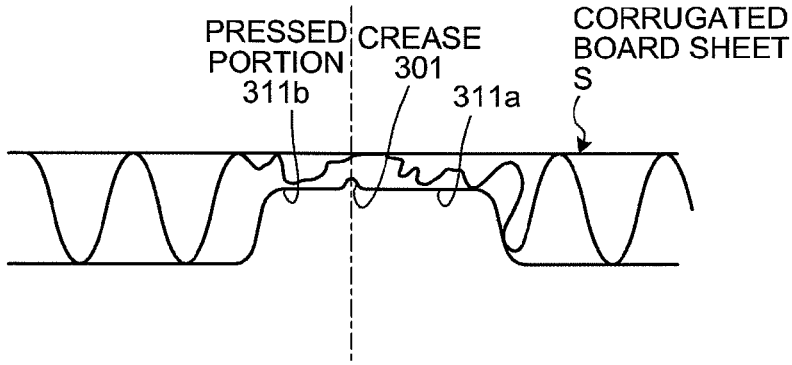

The first pressing portion 78 and the second pressing piece 73 are arranged opposite to each other across the protruding portion 75 and in an alternate manner in the circumferential direction. Therefore, as shown in FIGS. 9, 11B, and 11C, the pressed portions 311*a* to 314*b* with different widths can be formed on the both sides of each of the creases 301 to 304 on the inner linerboard 102. That is, the pressed portions 311*a*, 312*a*, 313*a*, and 314*a* with wide widths are formed by the first pressing portion 78 on the one side of the creases 301 to 304 formed by the protruding portion 75 on the inner linerboard 102, and the pressed portions 311*b*, 312*b*, 313*b*, and 314*b* with narrow widths are formed by the second pressing piece 73 on the on the opposite side. As a result, the pressed portions 311*a*, 312*a*, 313*a*, and 314*a* with wide widths and the pressed portions 311*b*, 312*b*, 313*b*, and 314*b* with narrow widths are alternately arranged with respect to each other in the conveyance direction of the corrugated board sheet S.

After the creases 301 to 304 and the pressed portions 311*a* to 314*b* are formed on the corrugated board sheet S by the upper and the lower creasing heads 43 and 44, the corrugated board sheet S is conveyed by the conveying rolls 49 and 50 as shown in FIG. 1. When the corrugated board sheet S passes between the upper and the lower slotting heads 47 and 48, slots 401 to 403 (see FIG. 9) are formed by the slotter knives 47*a* of the upper slotting head 47, and a joint flap 404 (see FIG. 9) is also formed.

The corrugated board sheet S is then subjected to the creasing process and the slotting process performed by the slotter-creaser unit 13, and conveyed to the folding unit 14. The folding unit 14 performs the folding process to make the corrugated box B. Specifically, as shown in FIGS. 1 and 10, the corrugated board sheet S held by the guide rail 51 and the conveying belt 52 is conveyed so that the glue applying unit 53 applies glue to the joint flap 404 and the folding bar 54 and the folding belt 55 fold the corrugate board sheet S, thereby the joint flap 404 is jointed.

At this state, the creases 301 to 304, and the wide pressed portions 311*a*, 312*a*, 313*a*, and 314*a*, the narrow pressed portions 311*b*, 312*b*, 313*b*, and 314*b* are formed on the corrugated board sheet S in the manner described above, thereby forming each the wide pressed portion 311*a*, 312*a*, 313*a*, and 314*a* and the narrow pressed portion 311*b*, 312*b*, 313*b*, and 314*b* alternately in the traveling direction.

Figure 11D:
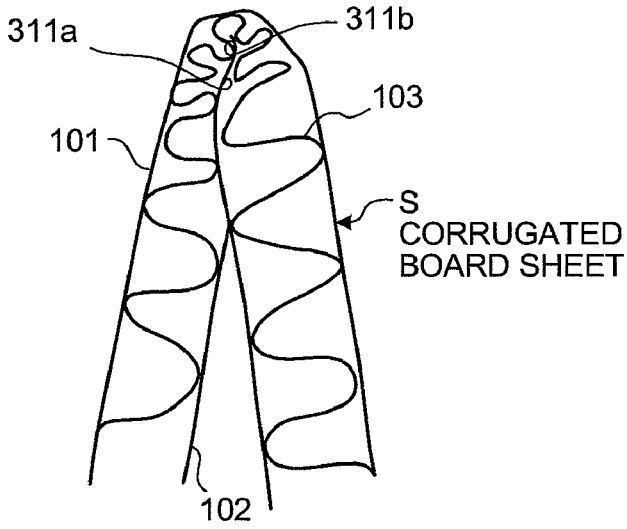
Figure 11E:
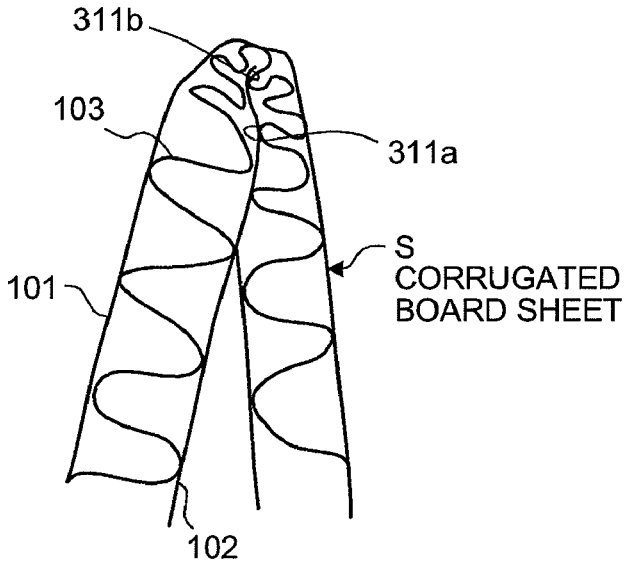

Therefore, as shown in FIGS. 11D and 11E, when the corrugated board sheet S is folded by the folding unit 14, each of the narrow pressed portions 311*b*, 312*b*, 313*b*, and 314*b* fits into each of the wide pressed portions 311*a*, 312*a*, 313*a*, and 314*a* to prevent interference with each other. Furthermore, each of the narrow pressed portions 311*b*, 312*b*, 313*b*, and 314*b* is configured to fit into each of the wide pressed portions 311*a*, 312*a*, 313*a*, and 314*a* in an alternate manner in the longitudinal direction of the corrugated board sheet S. Thus, folding positions of the corrugated board sheet S are hardly misaligned from the creases 301 to 304.

The corrugated box B is delivered to the hopper device 61 by the delivery roll 56 in the counter-ejector unit 15. At this state, the leading edge of the corrugated box B hits the ware plate 63, is aligned by the aligning plate 64, and the corrugated box B is piled on the elevator 62. The predetermined number of the corrugated boxes B on the elevator 62 are grouped into a batch, and transferred by the transfer conveyor 65 to next processing.

As described above, the slotter-creaser unit 13 includes the upper and the lower creasing heads 43 and 44. The protruding portion 75 is arranged on the periphery of the lower creasing head 43 in the circumferential direction. The first and the second pressing portions 78 and 79 having different lengths and different curvature radiuses in the width direction are arranged opposite to each other across the protruding portion 75 and in an alternate manner in the circumferential direction.

Therefore, when the lower creasing head 44 performs the creasing process on the corrugated board sheet S, the creases 301 to 304 are formed by the protruding portion 75, and the pressed portions 311*a* to 314*b* are formed by the first and the second pressing portions 78 and 79 on the sides of the protruding portion 75. Specifically, each of the wide pressed portions 311*a*, 312*a*, 313*a*, and 314*a* and each of the narrow pressed portions 311*b*, 312*b*, 313*b*, and 314*b* are alternately formed on the both sides of the protruding portion 75 such that each of the wide pressed portions 311*a*, 312*a*, 313*a*, and

314*a* and each of the narrow pressed portions 311*b*, 312*b*, 313*b*, and 314*b* faces each other across the protruding portion 75. At the same time, each of the wide pressed portions 311*a*, 312*a*, 313*a*, and 314*a* and each of the narrow pressed portions 311*b*, 312*b*, 313*b*, and 314*b* are arranged in the alternate manner in the longitudinal direction of the creases 301 to 304. Thus, when the corrugated board sheet S is folded along the creases 301 to 304, portions adjacent to the creases do not interfere with each other, preventing misalignment of folded positions. Thus, the positions of folding the corrugated board sheet S can be uniform regardless of a type or a property of the corrugated board sheet S. As a result, folding precision can be improved.

Furthermore, the lower creasing head 44 is formed by fixing the head body 71 having the protruding portion 75 and the first and the second attaching portions 76 and 77 arranged across the protruding portion 75 to the roll shaft 42. Also, the first pressing piece 72 having the first pressing portion 78 is fixed to the first attaching portion 76 and the second pressing piece 73 having the second pressing portion 79 is fixed to the second attaching portion 77. Therefore, the first and the second pressing portions 78 and 79 having different lengths and different curvature radiuses in the width direction can be easily arranged opposite to each other across the protruding portion 75. As a result, proccesability can be enhanced while reducing processing costs.

Moreover, the head body 71 is divided into two parts in the circumferential direction, and the pressing portion is divided into a plurality of parts to arrange the first and the second pressing pieces 72 and 73 in the alternate manner. Therefore, fixability of the head body 71 to the roll shaft 42 can be enhanced, and the first and the second pressing portions 78 and 79 having different lengths and different curvature radiuses in the width direction can be easily arranged opposite to each other across the protruding portion 75 and in the alternate manner. As a result, proccesability can be enhanced while reducing processing costs.

Furthermore, the first and the second pressing portions 78 and 79 are arranged on the periphery of the lower creasing head 44 along with the length of the corrugated board sheet S, and the wide pressed portions 311*a*, 312*a*, 313*a*, and 314*a* and the narrow pressed portions 311*b*, 312*b*, 313*b*, and 314*b* are arranged in the longitudinal direction in the alternate manner. Therefore, the folding positions can be uniform.

Moreover, the corrugated-box making machine according to the embodiment includes the feeding unit 11, the printing unit 12, the slotter-creaser unit 13, the folding unit 14, and the counter-ejector unit 15. The slotter-creaser unit 13 the upper and the lower creasing heads 43 and 44, and the protruding portion 75 is arranged on the periphery of the lower creasing head 43 in the circumferential direction. The first and the second pressing portions 78 and 79 having different lengths and different curvature radiuses in the width direction are arranged opposite to each other and in the alternate manner in the circumferential direction.

Therefore, when the lower creasing head 44 performs the creasing process on the corrugated board sheet S, the wide pressed portions 311*a*, 312*a*, 313*a*, and 314*a* are formed on the one side of the protruding portion 75 and the narrow pressed portions 311*b*, 312*b*, 313*b*, and 314*b* are formed on the opposite side. At the same time, the wide pressed portions 311*a*, 312*a*, 313*a*, and 314*a* and the narrow pressed portions 311*b*, 312*b*, 313*b*, and 314*b* are arranged in the alternate manner with respect to each other in the longitudinal direction. Thus, when the corrugated board sheet S is folded along the creases 301 to 304, portions adjacent to the creases do not interfere with each other, preventing misalignment of folded positions. Thus, the positions of folding the corrugated board sheet S can be uniform regardless of a type or a property of the corrugated board sheet S. As a result, folding precision can be improved.

The number of divided parts of the head body 71, and the first and the second pressing portions 78 and 79 is not limited to those described in the embodiment, and can be set as appropriate depending on the length and the shape of the corrugated board sheet S.

It is described in the embodiment that the first and the second pressing portions 78 and 79 having different lengths and different curvature radiuses in the width direction are arranged opposite to each other across the protruding portion 75 of the lower creasing head 44. Alternatively, pressing portions having different lengths and the same curvature radiuses in the width direction, or pressing portions with the same length and each different curvature radius can be arranged opposite to each other across the protruding portion.

Furthermore, the first and the second pressing portions 78 and 79 can be arranged in the alternate manner on a part of the periphery in the circumferential direction, instead of the entire periphery, of the lower creasing head 44. One example is that pressing portions with the same lengths and the same curvature radiuses in the width direction are arranged opposite to each other across the protruding portion 75, and the first and the second pressing portions with different length or with different curvature radius in the width direction are arranged opposite to each other across the protruding portion on a predetermined position in the circumferential direction in the alternate manner.

Moreover, although the head body 71 and each of the pressing pieces 72 and 73 are separately arranged in the embodiment, they can be integrated.

According to an aspect of the present invention, a creasing device includes a creasing roll having a protruding portion corresponding to a center position of the crease and arranged on a periphery of the creasing roll in a circumferential direction, and a pressing portion arranged on both sides of the protruding portion in a width direction, wherein the pressing portion includes a first pressing portion and a second pressing portion having different lengths in the width direction and arranged opposite to each other across the protruding portion and in an alternate manner in the circumferential direction. Therefore, when a creasing process is performed by the creasing roll, a wide pressed portion and a narrow pressed portion are formed opposite to each other across the crease by the first and the second pressing portion in a longitudinal direction. As a result, when the corrugated board sheet is folded along the crease, inner parts adjacent to the crease do not interfere with each other, and a folding position is not misaligned toward one direction. Thus, the folding position can be uniformly set regardless of property of a corrugated board sheet, resulting in improving a folding precision.

Furthermore, according to another aspect of the present invention, a creasing device includes a creasing roll having a protruding portion corresponding to a center position of the crease and arranged on a periphery of the creasing roll in a circumferential direction, and a pressing portion arranged on both sides of the protruding portion in a width direction, wherein the pressing portion includes a first pressing portion and a second pressing portion having different curvature radiuses in the width direction and arranged opposite to each other across the protruding portion and in an alternate manner in the circumferential direction. Therefore, when a creasing process is performed by the creasing roll, a wide pressed portion and a narrow pressed portion are formed opposite to each other across the crease by the first and the second pressing portion in a longitudinal direction. As a result, when the corrugated board sheet is folded along the crease, inner parts adjacent to the crease do not interfere with each other, and a folding position is not misaligned toward one direction. Thus, the folding position can be uniformly set regardless of property of a corrugated board sheet, resulting in improving a folding precision.

Moreover, according to still another aspect of the present invention, the creasing roll includes a body having a first attaching portion and a second attaching portion arranged opposite to each other across the protruding portion and fixed to a rotatable shaft, a first pressing piece having the first pressing portion and to be fixed to the first attaching portion, and a second pressing piece having the second pressing portion and to be fixed to the second attaching portion. Therefore, the first and the second pressing portions having different lengths or different curvature radiuses in the width direction can be easily formed on the both sides of the protruding portion. Thus, proccesability can be improved and processing costs can be reduced.

Furthermore, according to still another aspect of the present invention, the body is evenly divided into two parts in the circumferential direction, and the pressing portion is divided into a plurality of parts in the circumferential direction to alternately arrange the first pressing piece and the second pressing piece. Therefore, the fixability of the body to the rotatable shaft can be improved, and the first and the second pressing portions having different lengths or different curvature radiuses in the width direction can be easily formed on the periphery of the creasing roll in the circumferential direction. Thus, proccesability can be improved and processing costs can be reduced.

Moreover, according to still another aspect of the present invention, the first pressing portion and the second pressing portion are arranged with respect to a length of the corrugated board sheet on the periphery of the creasing roll. Therefore, a wide pressed portion and a narrow pressed portion can be alternately formed in a longitudinal direction of the crease. Thus, the folding position can be uniform.

Furthermore, according to still another aspect of the present invention, a corrugated-box making machine includes a feeding unit, a printing unit, a slotter-crease unit, a folding unit, and a counter-ejector unit. The slotter-creaser unit includes a creasing roll having a protruding portion corresponding to a center position of the crease and arranged on a periphery of the creasing roll in a circumferential direction, and a pressing portion arranged on both sides of the protruding portion in a width direction, wherein the pressing portion includes a first pressing portion and a second pressing portion having different lengths or different curvature radiuses in the width direction and arranged opposite to each other across the protruding portion and in an alternate manner in the circumferential direction. Therefore, when a creasing process is performed on the corrugated board sheet by the creasing roll, the crease is formed by the protruding portion and the wide pressed portion and the narrow pressed portion are formed on the both sides of the crease by the first pressing portion and the second pressing portion in an alternate manner in the longitudinal direction of the crease. As a result, when the corrugated board sheet is folded along the crease, inner parts adjacent to the crease do not interfere with each other, and a folding position is not misaligned toward one direction. Thus, the folding position can be uniformly set regardless of property of a corrugated board sheet, resulting in improving a folding precision, and a corrugated box with high quality can be manufactured.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A creasing device that forms a crease on a corrugated board sheet along a flute of a fluted inner sheet between linerboards of the corrugated board sheet, the creasing device comprising:

a creasing roll having:

a protruding portion corresponding to a center position of the crease and arranged on a periphery of the creasing roll in a circumferential direction;

a pressing portion arranged on both sides of the protruding portion in a width direction with respect to the creasing roll, wherein the pressing portion includes a first pressing portion and a second pressing portion having different lengths in the width direction and arranged opposite to each other across the protruding portion and in an alternate manner in the circumferential direction;

a body having a first attaching portion and a second attaching portion arranged opposite to each other across the protruding portion and fixed to a rotatable shaft;

a first pressing piece having the first pressing portion and to be fixed to the first attaching portion; and a second pressing piece having the second pressing portion and to be fixed to the second attaching portion.

2. The creasing device according to claim 1, wherein the body is evenly divided into two parts in the circumferential direction, and the pressing portion is divided into a plurality of parts in the circumferential direction to alternately arrange the first pressing piece and the second pressing piece.

3. The creasing device according to claim 1, wherein the first pressing portion and the second pressing portion are arranged along with a length of the corrugated board sheet on the periphery of the creasing roll.

* * * * *